US006531078B2

(12) United States Patent
Laine et al.

(10) Patent No.: US 6,531,078 B2
(45) Date of Patent: Mar. 11, 2003

(54) METHOD FOR FOAM CASTING USING THREE-DIMENSIONAL MOLDS

(75) Inventors: Eino Laine, Kyminlinna (FI); Kay Rökman, Karhula (FI); Hanna Rahiala, Karhula (FI); Jonathan George, Mathi (IT); Andrea Grosso, Turin (IT)

(73) Assignee: Ahlstrom Glassfibre Oy, Karhula (FI)

( * ) Notice: Subject to any disclaimer, the term of this patent is extended or adjusted under 35 U.S.C. 154(b) by 0 days.

(21) Appl. No.: 09/792,039

(22) Filed: Feb. 26, 2001

(65) Prior Publication Data

US 2002/0117768 A1 Aug. 29, 2002

(51) Int. Cl.[7] ..... B28B 1/26

(52) U.S. Cl. ..... 264/86; 264/87; 264/122; 264/320

(58) Field of Search ..... 264/86, 87, 122, 264/320, DIG. 48, 45.3, 50

(56) References Cited

U.S. PATENT DOCUMENTS

| | | | | |
|---|---|---|---|---|
| 4,303,472 A | * | 12/1981 | Walker et al. | 162/221 |
| 4,344,804 A | * | 8/1982 | Bijen et al. | 264/87 |
| 4,734,321 A | * | 3/1988 | Radvan et al. | 428/283 |
| 4,857,147 A | * | 8/1989 | Danforth et al. | 162/156 |
| 4,874,304 A | * | 10/1989 | Ito et al. | 264/86 |
| 4,882,111 A | * | 11/1989 | Murata | 264/87 |
| 4,882,114 A | * | 11/1989 | Radvan et al. | 264/86 |
| 5,169,580 A | | 12/1992 | Marcus | |
| 5,277,854 A | | 1/1994 | Hunt | |
| 6,048,440 A | | 4/2000 | Baker | |

FOREIGN PATENT DOCUMENTS

| | | |
|---|---|---|
| EP | 0 323 642 | 7/1989 |
| EP | 0 378 001 | 7/1990 |

OTHER PUBLICATIONS

Japanese Abstract of JP 6–15662, Apr. 11, 2000.
International Search Report with mailing date of Oct. 22, 2002.

* cited by examiner

*Primary Examiner*—Allan R. Kuhns
(74) *Attorney, Agent, or Firm*—Nixon & Vanderhye, P.C.

(57) ABSTRACT

Disclosed is a method of producing a non-woven web of fibrous or particulate material comprising: formation of a foam slurry; deposition of that slurry onto a foraminous element having a three-dimensional mold; and formation of a web having a three-dimensional shape that is not substantially planar by removal of foam from the slurry through the foraminous element and drying the web. An apparatus therefor is also disclosed. The method may be used in production a variety of products, including automotive pleated fluid and air filters, pleated heating and/or air conditioning (HVAC) filters, shaped breathing mask filters and bacterial filters, laminated cleaning products with superabsorbent middle layers, such as a mop wipe shape to fit a cleaning mop head, and other products.

34 Claims, 4 Drawing Sheets

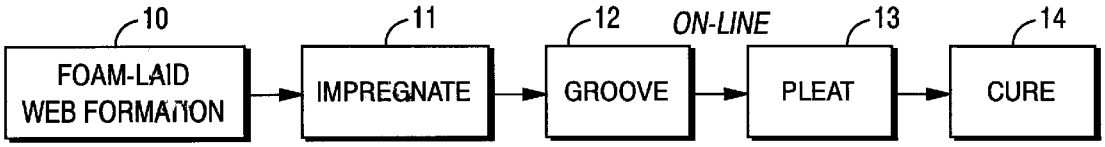
*Fig. 1* *(Prior Art)*
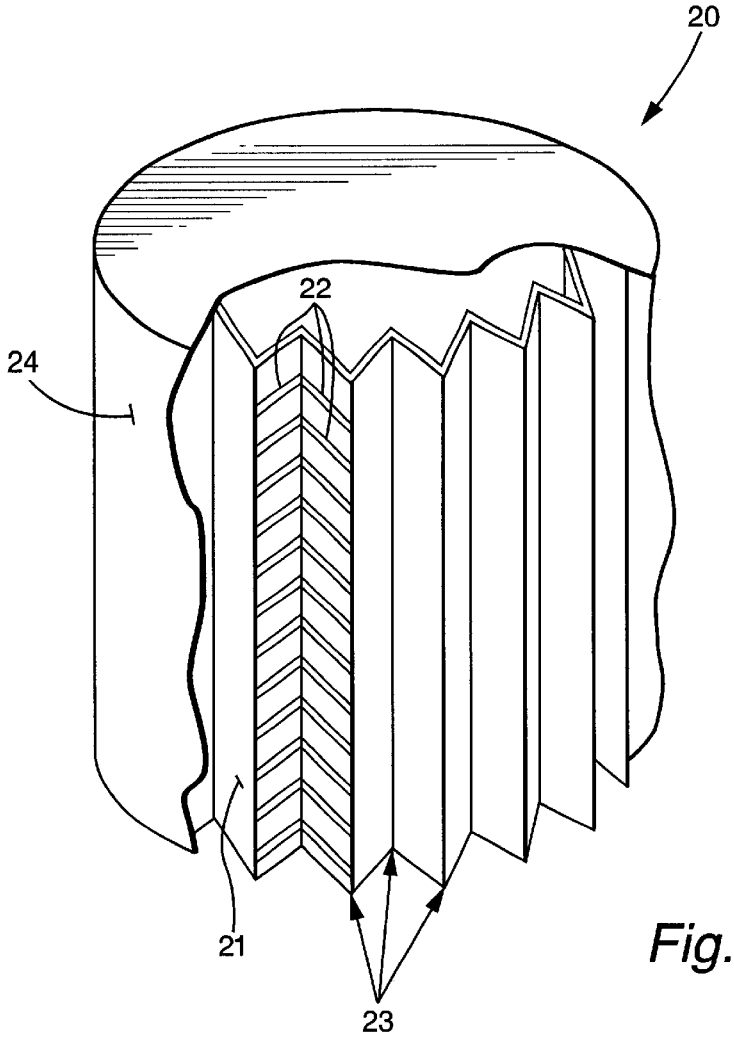
*Fig. 2*

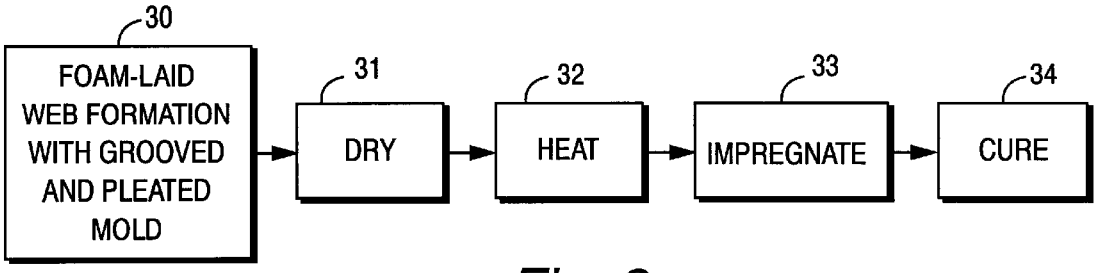
Fig. 3
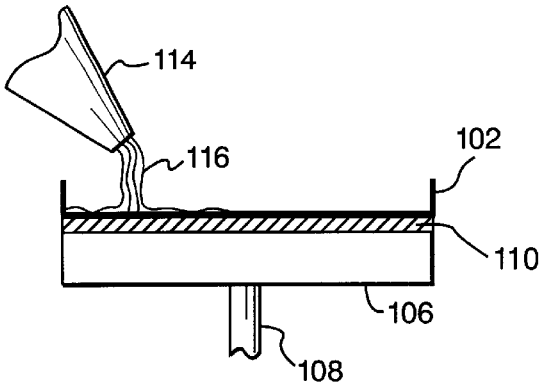
Fig. 4A
Fig. 4B
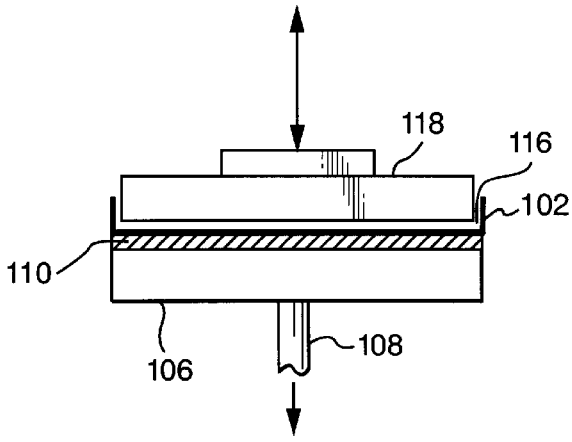

METHOD FOR FOAM CASTING USING THREE-DIMENSIONAL MOLDS

BACKGROUND

The invention relates to the utilization of foam processes for making non-woven webs using particular raw materials, and for making particular end products. Foam processes are basically as described in U.S. Pat. Nos. 3,716,449, 3,871,952, and 3,938,782 (the disclosures of which are incorporated by reference herein), and in pending U.S. application Ser. No. 08/923,900 filed Sep. 4, 1997 and U.S. application Ser. No. 09/098,458 filed Jun. 17, 1998, the disclosures of all of which are also incorporated by reference herein.

Foam processes are normally used for making planar forms having a uniform thickness, i.e., two-dimensional shaped forms, during web formation. In accordance with the present invention, a three-dimensional shaped form is created by using a three-dimensional mold during web formation from one or more foam layers. Using a three-dimensional mold, e.g., a wire mesh mold, a pleated or grooved filter product, for example, can be formed directly from a foam having fibers or particles which, when applied to the mold, form the product. A wide variety of products can be produced using the foam processes and three-dimensional molds disclosed herein. For example, three-dimensional molds and foam processes are useful to produce a wide variety of filter products, including automotive pleated fluid and air filters, pleated heating and/or air conditioning (HVAC) filters, shaped breathing mask filters and bacterial filters, laminated cleaning products with super absorbent middle layers, such as a mop wipe shaped to fit a cleaning mop head, and other products.

The present invention can be used to eliminate subsequent mechanical pleating steps or milling steps previously used to create pleats and grooves in a two-dimensional planar web sheet created using two-dimensional planar molds and foam processes. In particular, the present invention obviates the prior art process of mechanically cutting grooves and other shapes to form a three-dimensional planar-shaped product after it has been formed using foam processes. The present invention avoids the prior need for process equipment that shapes the substantially planar intermediate web products formed from two-dimensional molds into a three-dimensional final product. The present invention is particularly suited for use in production of pleated and grooved filter papers, especially those having applications in automobiles.

The foam process of web making is used for making products, e,g., webs using particles or fibers, e.g., short cut fibers, synthetic fiber materials, fibers from mechanical cellulose wood pulp or chemical cellulose wood pulp, or other web materials. Utilizing the foam process, it is possible to produce three-dimensional, non-planar webs from a variety of fibers, particles or combinations of fibers and particles.

One application of the invention relates to the production of pleated or grooved filter paper, particularly for automotive use. Filter paper started to be used in automobiles some 40–50 years ago, and today is standard equipment in every car with a combustion engine. The applications for filter papers today can be divided into the following grade categories: auto air, oil, heavy-duty air (HDA), fuel media, and cabin air. The auto air media/filter paper is designed to trap the particles entering the engine with the air. The HDA filter paper has the same function, but is designed for a more demanding environment with large amounts of dust in the air (e.g., earth moving machines, etc.). An oil media/filter paper is designed to take the particles out of the oil stream entering the engine. The fuel media/filter paper is designed to filter particles from gasoline or diesel fuel before it enters the engine. The cabin air media/filter paper is designed to trap the outside particles before they come into the cabin or compartment where the passengers are sitting. There are also other applications for such filter papers.

Automotive filter papers have previously been produced according to wet-laid processes, which date back to the early part of the 1900s. In the wet-laid process, fibers are broken up under agitation in a pulper. The fibers are then pumped in a liquid slurry through deflakers and refiners to the paper machine. The deflakers and refiners disperse the fibers, and give them a better surface for generating bonding strength. The main components on the paper machine are the wet end and the dry end. Between the pulper and the wet end, various types of wet and dry strength enhancing chemicals are also added. The wet end comprises a headbox and dewatering elements. Typically the headbox has a flat fourdrinier, incline wire, or cylinder type foraminous element. The dewatering elements are designed to suck out water from the slurry to dewater it from roughly a 0.05% fiber consistency to a 25% fiber consistency on a moving wire (foraminous element). After the wet end, the media enters the dry end. The objective there is to dry the filter media from 25% to about a 98–99% fiber consistency.

The filter media is now either impregnated "on-line" on the same paper machine, or rolled up and impregnated "off-line" on a separate impregnation machine. The objective of the impregnation process is to fully saturate the media with a resin or latex (thermosetting or thermoplastic), and thereby give the media its final mechanical strength as well as making it convertible into a filter. The impregnation process basically includes an impregnation unit followed by dryers. The impregnation unit can be a size-press, roll coater, curtain coater, or the like, and the dryers can be any conventional contact/non-contact types. When the media reaches about a 10–15% moisture content, the oil and HDA media types are grooved, giving them a continuous S-shape in the machine direction. Grooving the media type increases the overall filtration surface and helps keep the subsequently formed pleats separated when pleating the media and building the filter element.

After impregnation the media is slit into various slit width sheets before packaging and sending to a customer. At the customer site, the media is mechanically pleated on conventional pleating machines giving the media its final physical configuration before building a filter element containing the filter paper. How the ends of the media are sealed, the media further polymerized, and which characteristics are particularly important, depend on the customer and end application, and these details are conventional.

The process of the U.S. patent application Ser. No. 09/098,458 discusses the manufacture of a planar sheet of filter paper by means of the foam process, and then subsequently the sheet is grooved and pleated to make the actual filter material. The present invention forms the filter paper on a mold, which is grooved, pleated, or grooved and pleated itself. There is no need to perform subsequent mechanical steps of pleating, grooving or otherwise imparting three-dimensional shapes to the web product extracted from the molding process.

Forming products from a fiber or particle foam is advantageous over wet-laid processes. For example, filter paper has been manufactured using a water-laid process. In that process, fibers in a liquid suspension are introduced onto a grooved mold. The depth of the liquid slurry is relatively shallow. Soon after the introduction of the fiber suspension, the slurry surface sinks below the top portion of the lower mold, losing the hermetic seal permitting suction from beneath the mold to avoid removing water from the fibrous slurry. When the seal is lost, the suction acts primarily on the portion of the mold having no contact with the suspended fibers. Consequently, the fiber formation at the bottom of the mold is slow and not optimal. Additionally, there is a possibility that the top portions of the mold would collect a smaller number of fibers than the bottom portions, because the fibers in the liquid slurry tend to settle and concentrate at the bottom of the mold. In contrast, the foam processes disclosed herein involve one or more layers of foam that each form a relatively-deep layer of foam in a three-dimensional mold. Because of the depth of the foam, it is unlikely that the upper surface of the foam will sink below the peaks in the lower mold surfaces. In addition, an upper mold may be used to shape the upper surface of the foam so as to conform to the shape of the underlying lower mold, and thereby avoiding having the tops of a lower mold extend entirely through a foam layer.

Another problem exists with wet-laid processes if the filter paper is manufactured using several different layers, materials, substrates, or combinations thereof. While being introduced on a previous layer (or layers) in dilute suspensions, subsequent layers tend to orient the fibers from a previous layer in the bottoms of the grooves. This causes the final product to have an uneven thickness, which in turn causes a decrease in filtering ability. Foam processes are better suited to layering different foams, where each foam layer has a different consistency of fibers or particles. The foam layers tend to retain randomly oriented fibers, which is often desirable. Alternatively, the fibers in the foam can be oriented parallel to the flow path in the foam injection nozzle. By injecting the foam into the mold vertically from the nozzle, it is possible to preserve the generally-vertical fiber orientation in the foam as deposited in the mold. The vertical fiber orientation in a final web product can be beneficial to form relatively-thick webs and relatively-porous webs.

In these prior art wet-laid and foam processes, there are potential problems caused on the one hand by forming in wet-leid processes, and on the other hand by pleating and grooving the filter paper separately in foam processes. First, increasing process steps cause higher manufacturing costs. Combining several process steps into one, the overall process becomes shorter and, consequently, less expensive. Second, mechanical changes to the formed filter paper may decrease the durability of the final product. Bending a formed planar filter paper to form pleats and grooves creates stress to the bent portions, and that stress may reduce the quality of the final product through rapid deterioration.

SUMMARY OF INVENTION

The present invention is a foam web manufacture process that uses molds to shape and dry the foam into three-dimensional products, such as three-dimensional filters. These products may be single layered formed from a single application of foam, or a laminate formed of several layers of different foams. In a simplistic description, foam comprises a slurry of air, water, surfactant, and fibers or particles. The type of fibers, particles, or combination of fiber and particles will depend on the product to be produced. For example, the fibers in the foam may be short cut fibers, having an average length of 0.05 mm (millimeters) or less. The fibers or particles conform to a three-dimensional mold as the foam is deposited in the mold. As the foam is deposited on the mold, the water and air (which is in the foam as air bubbles having a wide variety of different diameters) are drained through the mold, extracted and reused. The fibers or particles from the foam are deposited on the mold to form the web product. The fibers or particles are dried on the mold and the completed three-dimensional product is removed from the mold. The web product may be formed from a combination of fibers and particles, or entirely of particles that are deposited from the foam.

The introduction of the foam onto three-dimensional molds is performed in a careful manner, to prevent the problems experienced by the water-laid process. These problems can be prevented, in part, because the consistency of the foam is 1% to 10% (and can be 20% for foams with super-absorbent) fibers) and is higher than the typically 0.01% to 0.5% consistency of the slurry in the conventional water-laid process. As a consequence of the higher consistency, the use of the foam process permits formation of thicker products, such as thicker filter papers or thicker layers of paper in a single stage. If larger consistencies are used in liquid-laid processes, the fibers tend to aggregate and form flocs before web formation occurs. Floc formation decreases the quality of the final product because of the associated fluctuations in thickness and other properties of the filter paper, which in turn cause variations in filtering ability within the same product.

Additionally, the foam requires much less liquid than the liquid-laid process, reducing the water consumption significantly. A reduction in the water consumption decreases the size of equipment needed for transporting liquid downstream of the mold. After the foam is drained from the mold, the foam can be substantially reused. Generally, only fibers and particles, and possibly a surfactant, are added to the reused foam before it is deposited in another mold.

In one embodiment, after foam is introduced onto a bottom mold, a complementary top mold is placed on top. Preferably, the top mold is substantially the inverse of the bottom mold, such that the ridges of the top mold substantially fit in the grooves of the bottom mold. Similarly, the grooves of the top mold fit substantially around the ridges of the bottom mold. The top mold can be used to ensure that the top portions of the bottom mold are covered with foam and thus sealed. Ensuring that foam remains over the top portions of the bottom mold prevents the loss of the seal and the associated problems with suction described above. Additionally, the top mold can be used to apply pressure on the foam, increasing the pressure on the top surface of the foam and assisting the removal of foam from the filter layer.

After the filter layer is substantially formed, the top mold is removed and the filter paper can be either taken to the drying phase or taken to a phase wherein another layer of foam is deposited. Although substantially the same foam material could be deposited using a new headbox in the manner described above, a different foam material can be deposited. Additional layers, for example three or more layers, could be deposited on the formed layers. The number of potential layers is determined partially by the desired properties of the final product.

In another embodiment, the production machine is a batch-type machine, wherein each batch contains at least one bottom mold. For each batch, there is a trough, which contains, for example, five rows and five columns of bottom molds. After the desired amount of foam is deposited using a headbox on the bottom molds in the trough, an insert containing a matching number of top molds is placed on top of the foam. That trough and insert move down the production line, and an empty trough begins the batch process anew.

In another embodiment, the production machine is a continuous-type machine, wherein the bottom and top molds are incorporated into a moving wire, which is also called a foraminous element, and roller system. The bottom mold moving wire contains repeated bottom molds, such that as the bottom mold moves, e.g., laterally or rotationally, new bottom molds are exposed to the headbox. Similar to the batch process, the headbox deposits foam on the bottom molds mounted on the bottom mold moving wire. Thereafter, a complementary top mold attached to a top mold belt is placed on top of a corresponding bottom mold containing foam.

In a further embodiment, after a layer has been formed, the mold is opened. A similar procedure to the ones described above may be done such that another layer is formed. Alternatively, the recently formed layer, or layers, may be run through a blow-drying oven or similar equipment to aid in the drying process.

In yet another embodiment, multiple discrete layers of foam are deposited on the bottom mold before the top mold is placed on top of the foam. After deposition of each layer of foam, some foam may be drawn through the bottom mold without placing the top mold on top. Removing some foam may both ensure the foam maintains a reasonable height in the mold and reduce the overall process time. Alternatively, foam removal may occur after all layers have been deposited. In this embodiment, the top mold is useful when the height of the foam is less than the height of the bottom mold. In such circumstance, without a top mold the seal might be lost if a gap in the foam forms as the top portions of the lower mold extend up through the foam. The top mold prevents gaps in the foam by pressing the foam down into the lower mold, evenly distributing the foam in the lower mold and ensuring that the foam layer maintains a uniform thickness. A top mold is also advantageous to provide better drainage of the foam by adding pressure that forces the foam through the lower and upper molds, which are typically a wire mesh.

In a further embodiment, the foam layers are deposited in a quick sequence in a mold without a large time delay between layer depositions. For example, this can be done using multiple headboxes, each headbox depositing different foam with independent properties. Alternatively, this can be done using a single headbox with the capability of depositing different foams with independent properties. In the second example, the independent foam layers are still deposited sequentially, but the same headbox is used for all layers.

There are multiple advantages to using the present invention, and the following is a non-exhaustive list of benefits. First, the process is relatively fast, and delicate or reactive substances, like active carbon, odor removing substances, salts, super-absorbent products, etc., may be used without substantial degradation or substantial loss of properties. Second, the process can be operated in either batch- or continuous-type machines, providing flexibility in equipment or plant design. Third, the process uses foam, which provides the ability to deposit multiple layers without mixing different layers. Fourth, the process obviates the need to groove or pleat the filter paper after formation. Since the paper is not subjected to bending after formation, the risk of breaking the filter layers is minimal. Fifth, the process is useful with any short fiber, e.g., fibers of 50 mm or less, such as synthetic fibers, mechanically-treated wood pulp or chemically-treated wood pulp.

The present process has advantages over thermo-forming techniques used for shape filters. Thermo-forming is a post mold process to shape a filter element. Thermo-forming processes are unnecessary with the present invention that shapes a filter element using the same mold in which the fibrous foam is solidified into a three-dimensional fiber element. In addition, the foam used with the present process produces a more uniform filter product than does the wet-laid or dry-laid fiber processes typically associated with processes involving thermo-forming. However, thermo-forming can be used on the web product extracted from the mold and produced with the present invention.

While the present invention has been described in connection with the production of filter papers, the invention may be used to manufacture other three-dimensional products using foam. The present invention offers other advantages, which will become apparent to a person of ordinary skill in the art when considered in connection with the accompanying drawings.

BRIEF DESCRIPTION OF THE DRAWINGS

FIG. 1 is a schematic illustration of a prior art method for producing filter paper.

FIG. 2 is a schematic illustration of an automotive filter utilizing filter paper according to the invention.

FIG. 3 is a schematic illustration of a method for producing filter paper.

FIG. 4 is a schematic illustration of equipment for producing filter paper.

DETAILED DESCRIPTION OF THE DRAWINGS

Figure 5:
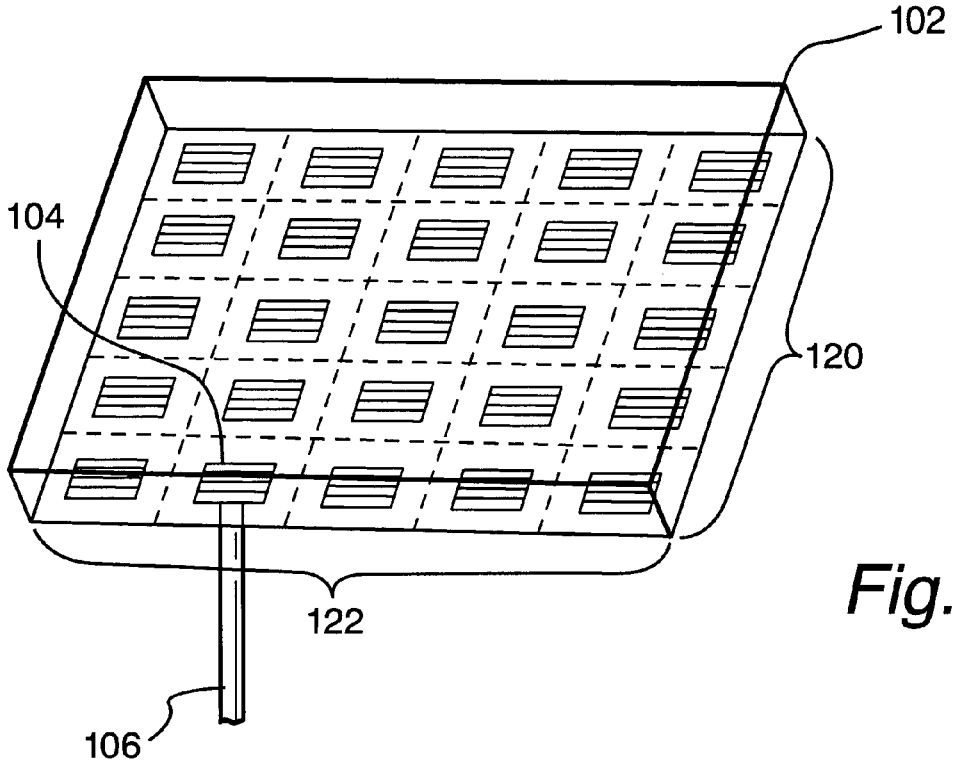
FIG. 5 is a schematic illustration of a trough containing multiple bottom molds.

FIG. 1 is a schematic depiction of a prior art process using foam to produce filter paper in an on-line manner. First, the web is formed using the foam-laid process as indicated in 10, in which a slurry of air, water, surfactant, and fibers are moved into contact with a moving foraminous conveyor element, and then foam is removed from the slurry through the element to form a non-woven web. The fibers are short cut fibers, having a length of 50 millimeters or less. The fibers may be formed of synthetic materials, of mechanical wood pulp, chemical wood pulp and other fibrous materials. Drying and other conventional steps are also practiced in processing the foam.

The rest of the steps in FIG. 1 are applicable to water-laid processes, impregnation with conventional resins or latexes to enhance the properties of the web taking place at 11, and conventional grooving being practiced as indicated at 12, when desired. The steps 10, 11, and 12 are typically practiced at the web production facility. The conventional pleat 13 and resin-curing 14 steps are practiced at a location where the actual filter paper will be made, and perhaps installed in conventional canisters. The same process as illustrated in FIG. 1 may be done in an off-line manner, wherein impregnation and grooving occurs at a facility apart from where foam-laid web formation occurs (not shown).

FIG. 2 schematically and simply illustrates an automotive three-dimensional filter 20 that may be made utilizing filter paper produced according to the present invention. The filter paper 21 is produced by the foam process, and conventional grooves 22 and conventional pleats 23 are illustrated schematically. The pleated and grooved filter paper 21 is then placed in a suitable canister 24. The mechanism for locating the filter paper 21 within canister 24 and the details of the canister, including how filter paper 21 is disposed in the canister, is conventional and depends upon the application or a customer's particular preference.

FIG. 3 schematically illustrates an embodiment of the present invention. Step 30 is the same as step 10 in FIG. 1, except the mold used to form the web formation in step 30 is a three-dimensional mold, e.g., a wire framed mold, whereas the mold used in step 10 is substantially planar. In a preferred embodiment, the mold includes grooves and pleats. Performing these process steps during web formation eliminates the necessity to perform those steps after web formation, as required by the prior art process. Other, conventional process steps may be performed after foam-laid web formation with grooves and pleats. A drying step 31 and a heating step 32 may be employed to dry and/or heat the fibers or particles on the mold after the foam has been drained from the mold. When generating the foam there may have been added some thermoplastic fibers or particles in the foam so that such could be later on in the process heat-treated. While heating the molded product the thermoplastic fibers or particles may be fused or melted to give strength and other desired properties to the product. This kind of a process is called thermo-molding. In addition, conventional resins or latexes to enhance the properties of the web taking may be added in process step 33. Additionally, a resin-curing step 34 may occur after impregnation step 33. Steps 30, 31 32 and 33 are typically practiced at the web production facility, but the resin-curing 34 step is typically practiced at a location where the actual filter paper will be made, and perhaps even installed in conventional canisters.

Figure 6:
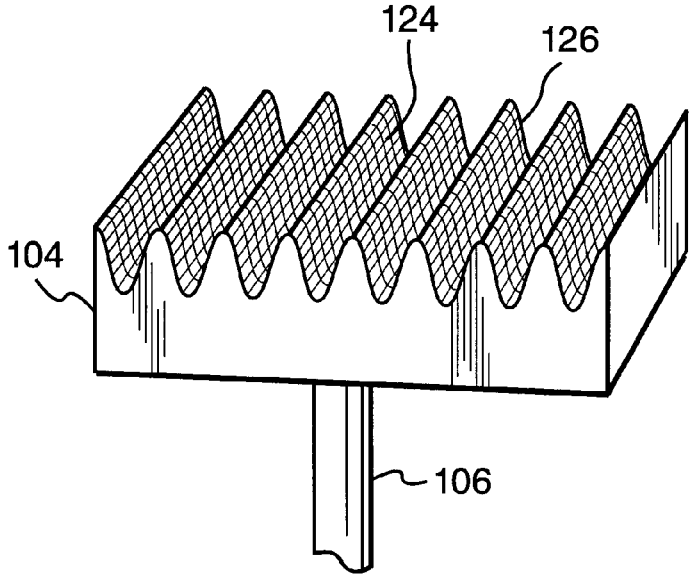
FIG. 6 is a schematic illustration of a bottom mold.

An embodiment of the present invention is shown schematically by FIGS. 4A, 4B, 5 and 6, wherein like parts are labeled with like numerals. FIGS. 4A and 4B illustrate a batch process for foam-laid web formation with grooves and pleats. As shown in FIG. 4A, the lower mold is filled with foam, and then a top mold assists in draining the foam from the molds, as shown in FIG. 4B. FIG. 5 illustrates a trough containing a single mold for use in a batch process. FIG. 6 illustrates an individual bottom mold with both grooves and pleats.

As shown by FIGS. 4A and 4B, trough 102 sits on foraminous mold element 110, e.g., a three-dimensional wire mesh having a shape conforming to a desired product shape (not shown). Underneath each trough 102 is a suction attachment 106 that attaches to the bottom of each mold 104 and suction line 108. Suction attachment 106 provides for foam removal during web formation from each mold 104, whereas suction line 108 provides for the aggregate foam removal from all molds 104 in trough 102. With further reference to FIGS. 4A and 4B, headbox 114, e.g., a foam nozzle vertical to the mold, deposits foam 116 into each mold 104 (not shown in FIGS. 4A and 4B) in trough 102. The fibers in the foam will generally have a randomized orientation as it flows from the headbox into the trough 102. This randomized fiber orientation may be desirable to provide structural support to the web product. Alternatively, the headbox nozzle may be selected to cause the fibers in the foam to become oriented parallel to the flow path through the nozzle. If the nozzle vertically deposits the foam into the trough 102, then the fibers will be generally vertically oriented in the trough and in the web product. Such a vertical orientation of fibers may be desirable for thickness and porosity of the web product.

After the foam is deposited on the lower mold, top mold insert 118 is placed on top of foam 116 in molds 104. The insert 118 has the mold shape of complementary forms to the bottom molds 104, such that the seal on the upper portions of bottom mold 104 is maintained. The upper insert 118 and trough 102 form a seal around the foam. Maintaining the seal permits suction line 108 to remove foam during web formation without loss of suction to some portions of bottom mold 104. Insert 118 may apply some pressure to force the removal of excess foam through suction attachment 106. The insert 118 may include a blower output to apply air pressure on the upper surface of the foam and, thereby, force the foam to better conform to the bottom mold. Moreover, another suction line may draw foam up through the top molds in the top mold and extract the foam that passes through the wire mesh of the top molds.

Trough 102 may contain multiple bottom molds 104. For example, FIG. 5 shows five rows 120 and five columns 122 of bottom molds 104. In this example, there are twenty-five bottom molds. However, this embodiment has at least one mold 104 and may have any finite number of molds 104 in trough 102. FIG. 6 schematically illustrates a bottom mold 104. A top mold insert 118 would have upper molds to match each bottom mold. Suction attachment 106 is beneath the mold 104, and suction attachment 106 is the intermediary between mold 104 and suction line 108 (suction attachment 106 is depicted as a pipe or similar piece of equipment in FIGS. 5 and 6, and as a box in FIGS. 4A and 4B and 7). Additionally, the three-dimensional nature of the mold 104 is shown by pleats 126 and grooves 124. However, the scope of the invention is not limited to shapes and forms solely comprising grooves or pleats. Since bottom mold 104 has grooves 124 and pleats 126, the product may have a three-dimensional form without subsequently adding grooves 124 and pleats 126.

Figure 7:
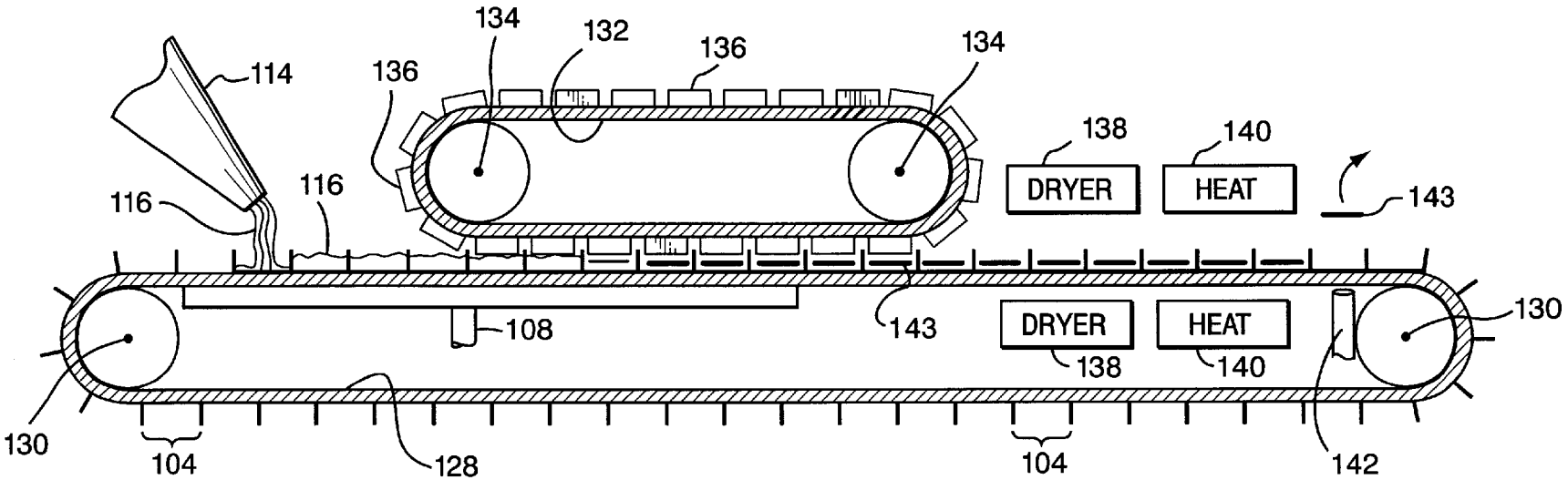
FIG. 7 is a schematic illustration of equipment for producing filter paper.

FIG. 7 schematically illustrates another embodiment wherein a continuous process produces a foam-laid web formation with grooves and pleats. Similar to FIGS. 4A, 4B, 5, and 6, like items are labeled with like numbers in FIG. 7. A series of individual bottom molds 104 are shown attached to foraminous conveyor element 128. Conveyor element 128 rotates in a clockwise manner around rollers 130, permitting continuous operation of the equipment. As conveyor (foraminous) element 128 moves an empty bottom mold 104 beneath headbox 114, headbox 114 deposits foam 116 into that bottom mold 104. Suction attachment 106 is attached to bottom molds 104, and suction line 108 removes excess foam during the process. Conveyor (foraminous) element 128 moves the filled bottom mold 104 containing foam 116 into contact with one of the top molds 136, which contains the complementary shape to bottom mold 104. Top mold 136 is attached to belt 132, which rotates around rollers 134 in a counter-clockwise manner.

The conveyor element 128 continues to move the lower mold 104, as the top mold is removed and the web product in the mold 104 is dried by a dryer 138 and a heater 140. An air blower 142 may force air through the lower mold 104 to extract the filter product 143. The heater 140 may, but not necessarily, be used to thermo-mold the three dimensional product while still in the mold. With respect to thermo-molding, the foam used to form the product may include thermoplastic fibers or materials, so-called binders. The foam is injected into the mold and the resulting product will already include thermoplastic fibers or particles. When the product is passed through the heater 140, these fibers or particles are fused or melted within the product to give strength and other properties to the product after the molding step. Moreover, a thermo-molding step may also include, in addition to thermal treatment, a treatment with pressure which can be performed by means of a blower or a specifically designed pressure mold.

Multiple headboxes are incorporated in exemplary headbox 114, and that headbox 114 may deposit more than one layer of foam during production. Multiple layers of foam may be used to produce a fiber filter element 143, wherein each layer may have a different fiber material or different density of fibers. Additionally, both insert 118 and top molds 136 do not need to be placed on trough 102 and bottom mold 104, respectively, until the final stage of web formation, e.g., when the height of foam layer is lower than the height of bottom mold. Moreover, multiple layers of foam 116 could be deposited before placing insert 118 on trough 102 or top mold 136 on bottom mold 104. Additionally, the amount and timing, i.e., process location, of foam removal through suction line 108 may be altered. For example, if multiple layers of foam 116 are deposited, foam removal may not occur until the all layers of foam have been deposited. Furthermore, bottom mold 104 may only contain grooves 124, i.e., without pleats 126, such that the product has only minor deviations from being substantially planar. Alternatively, bottom mold 104 may be any three-dimensional shape to be used in foam-laid web formation.

It should also be understood the the most simple embodiment for the top mold is a thin film of e.g. plastic or rubber which is inserted on top of the foam layer/layers. The only purpose of the film is to prevent the exposure of the top parts of the bottom mold to the atmosphere in order to maintain constant vacuum conditions within the mold.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of producing a three-dimensional web product comprising:

(a) generating a foam slurry of a liquid, air and fibers or particles;

(b) introducing the foam slurry in a mold having a three-dimensional, non-planar bottom mold element;

(c) sealing the foam between a top mold element and the bottom mold element; and (d) forming the web product having a three-dimensional shape conforming to said three-dimensional bottom mold element by removing foam from at least one of the top and bottom mold elements.

2. A method as in claim 1 further comprising:

(e) molding the web product after step (d).

3. A method as in claim 1 further comprising:

(e) thermo-molding the web product after step (d).

4. A method as in claim 1 wherein the foam slurry includes a surfactant.

5. A method as recited in claim 1 wherein said web product has a three-dimensional shape comprising grooves.

6. A method as recited in claim 3 further comprising impregnating the web product with resin or latex suitable for forming the web into a filter element.

7. A method as recited in claim 1 further comprising moving the foam slurry with a conveyor in conjunction with step (b).

8. A method as recited in claim 1 wherein the forming step is continuous.

9. A method as recited in claim 1 wherein the foam slurry includes fibers and particles.

10. A method as recited in claim 1 wherein the forming step is a batch process.

11. A method as recited in claim 1 wherein said web product has a three-dimensional shape comprising grooves and pleats and is filter element.

12. A method as recited in claim 8 further comprising impregnating the web product with resin or latex.

13. A method as recited in claim 12 further comprising curing the resin or latex which impregnates the web product.

14. A method as recited in claim 1 wherein said forming step is performed using a batch-type machine.

15. A method as recited in claim 14 wherein said batch-type machine has a trough comprising at least one bottom mold.

16. A method as recited in claim 2 wherein said molding step is performed using a batch-type machine having at least one bottom mold.

17. A method as recited in claim 16 wherein said batch-type machine has an insert comprising at least one top mold.

18. A method as recited in claim 17 wherein said at least one top mold and said at least one bottom mold are complementary.

19. A method as recited in claim 1 wherein said forming step is performed with a continuous-type machine.

20. A method as recited in claim 1 wherein steps (a)–(d) are repeated for multiple layers of said foam slurry.

21. A method as recited in claim 1 wherein steps (a)–(d) are repeated for multiple layers of said foam slurry.

22. A method as recited in claim 17 wherein multiple layers of foam slurry are applied to said mold prior to placing a top mold on said layers of foam slurry.

23. A method as recited in claim 20 wherein some foam is removed from the slurry after each layer of foam is deposited in the mold.

24. A method as recited in claim 3 wherein said thermo-molding is performed by applying heat and pressure to the web product.

25. A method as recited in claim 24, wherein said pressure is applied by a blower or a pressure mold.

26. A method as recited in claim 1 wherein the fibers or particles in the foam include thermoplastic fibers or thermoplastic particles.

27. A method as recited in claims 3 or 26 wherein said thermo-molding binds the web product by fusing or melting thermoplastic fibers or particles to give strength and other properties to the product.

28. A method of producing a three-dimensional web product comprising:

(a) generating a foam slurry of a liquid, air and fibers or particles;

(b) introducing the foam slurry in a mold having a three-dimensional, non-planar bottom mold element;

(c) forming the web product having a three-dimensional shape conforming to said three-dimensional bottom mold element by removing foam from the mold element and the forming step is performed with a continuous-type machine, and said continuous-type machine has multiple bottom molds.

29. A method of producing a three-dimensional web product comprising:

(a) generating a foam slurry of a liquid, air and fibers or particles;

(b) introducing the foam slurry in a mold having a three-dimensional, non-planar bottom mold element;

(c) forming the web product having a three-dimensional shape conforming to said three-dimensional bottom mold element by removing foam from the mold element and the forming step is performed with a continuous-type machine having multiple bottom molds, and (d) molding the web product after the forming step.

30. A method as recited in claim 29 wherein said cotinuous-type machine has a plurality of top molds.

31. A method as recited in claim 30 wherein said multiple top molds and said multiple bottom molds are complementary.

32. A method as recited in claim 30 wherein multiple layers of foam slurry are applied to said mold prior to placing a top mold on said layers of foam slurry.

33. A method as recited in claim 22 or 32 wherein foam is removed from the slurry after all layers of foam being deposited.

34. A method of producing a three-dimensional web product comprising:

(a) generating a foam slurry of a liquid, air and fibers or particles;

(b) introducing the foam slurry in a mold having a three-dimensional, non-planar bottom mold element;

(c) sealing the foam between a top mold element and the bottom mold element before removing foam from the mold elements, (d) forming the web product having a three-dimensional shape conforming to said three-dimensional bottom mold element by removing foam from at least one of the top and bottom mold elements while the foam is sealed between the mold elements.

* * * * *